US007905120B2

(12) United States Patent
Mamiya et al.

(10) Patent No.: US 7,905,120 B2
(45) Date of Patent: Mar. 15, 2011

(54) WASHING MACHINE WITH AIR WASH FUNCTION

(75) Inventors: Haruo Mamiya, Osaka (JP); Kenichiro Dohi, Osaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 214 days.

(21) Appl. No.: 12/087,736

(22) PCT Filed: Dec. 25, 2006

(86) PCT No.: PCT/JP2006/325768

§ 371 (c)(1),
(2), (4) Date: Jul. 14, 2008

(87) PCT Pub. No.: WO2007/086221

PCT Pub. Date: Aug. 2, 2007

(65) Prior Publication Data

US 2009/0049874 A1 Feb. 26, 2009

(30) Foreign Application Priority Data

Jan. 30, 2006 (JP) ..... 2006-021187

(51) Int. Cl.
*B08B 3/12* (2006.01)

(52) U.S. Cl. ..... 68/5 C; 68/5 R

(58) Field of Classification Search ..... 68/5 C, 68/5 R

See application file for complete search history.

(56) References Cited

U.S. PATENT DOCUMENTS

| | | | | |
|---|---|---|---|---|
| 4,625,432 | A * | 12/1986 | Baltes | 34/621 |
| 2001/0054202 | A1 * | 12/2001 | Severns et al. | 8/142 |
| 2002/0020027 | A1 * | 2/2002 | Noyes et al. | 8/149.2 |
| 2003/0108460 | A1 * | 6/2003 | Andreev et al. | 422/186.07 |
| 2005/0262883 | A1 * | 12/2005 | Yang et al. | 68/12.01 |

FOREIGN PATENT DOCUMENTS

| | | | |
|---|---|---|---|
| CN | 1702226 | A | 11/2005 |
| JP | 1-277596 | | 11/1989 |
| JP | 4-236957 | | 8/1992 |
| JP | 04236957 | A * | 8/1992 |
| JP | 2001-087590 | | 4/2001 |
| JP | 2002-320792 | | 11/2002 |
| JP | 2002320792 | A * | 11/2002 |
| JP | 2004-049254 | | 2/2004 |
| JP | 2005-124626 | | 5/2005 |
| JP | 2005-334636 | | 12/2005 |

* cited by examiner

*Primary Examiner* — Michael Barr
*Assistant Examiner* — Charles W Kling
(74) *Attorney, Agent, or Firm* — Rabin & Berdo, PC

(57) ABSTRACT

A washing machine including a treating tub that houses clothes and that has an outer tub and an inner tub rotatably provided in the outer tub; a motor for rotating the inner tub; a circulating air duct for extracting and returning air in the treating tub during drying; a blowing means for circulating the air in the circulating air duct; a heating device for heating the air circulated in the circulating air duct; an ozone generation device connected to the circulating air duct for generating ozone by discharge; a command key for instructing execution of air wash; an air wash execution control device for operating the blowing device, the ozone generation device and the heating device in a predetermined mode in response to command key instruction; and a selection key for selecting whether to rotate the inner tub or to stop the inner tub during execution of the air wash.

3 Claims, 8 Drawing Sheets

WASHING MACHINE WITH AIR WASH FUNCTION

BACKGROUND OF THE INVENTION

1. Field of the Invention

The present invention relates to a washing machine (electric washing machine).

2. Background of the Related Art

A washing machine provided with an ozone generator is proposed. For example, Japanese Unexamined Patent Publication No. 2002-320792 (Patent Document 1) proposes a washing machine supplying ozone generated in an ozone generator into a washing tub in wash-and-dry operation. A washing machine is described that can sterilize not only the laundry but also the washing tub, and a drying unit or the like which is a warm air circulating path.

The washing machine according to Patent Document 1 has a structure supplying ozone generated in an ozone generator into the washing tub during the wash-and-dry operation. Therefore, while the washing machine can sterilize clothes to be washed and clothes to be dried, the clothes cannot be sterilized unless the same are washed or dried. In other words, the washing machine must wash or dry the clothes to sterilize the clothes.

When clothes are worn only for a short period of time, a bad smell or the like may be adsorbed into the clothes, although the clothes are generally unsoiled. Examples of such a case may include adsorption of the smell of a cigarette or cigarette smoke into clothes due to company with a smoker, adhesion of pollen or the like to an overcoat while out in early spring, or removal of perfume traces adsorbed into clothes. In such a case where clothes are generally unsoiled and need not be washed and dried, but removal of a smell adsorbed into the clothes or sterilization of various bacteria and the like are required, a conventional washing machine cannot satisfy such a requirement.

The present invention has been proposed in order to solve this problem, and a main object thereof is to provide a washing machine capable of sterilizing/deodorizing clothes neither washed nor dried.

SUMMARY OF THE INVENTION

The invention is a washing machine comprising: a treating tub storing clothes, for washing and spin-drying the stored clothes; an ozone generation means for generating ozone by discharge; a supply means for supplying the ozone generated by the ozone generation means into the treating tub; a command key for instructing execution of air wash; and an air wash execution control means for operating the ozone generation means and the supply means in a predetermined mode in response to the instruction from the command key.

The air wash execution control means operates the supply means and intermittently operates the ozone generation means at a prescribed time interval in response to the instruction from the command key. The washing machine includes a heating means for heating a feed passage for the ozone or the treating tub, wherein the air wash execution control means operates the heating means in order to heat the ozone used for the air wash.

The treating tub has an outer tub and an inner tube rotatably provided in the outer tub, and the washing machine includes a motor for rotating the inner tub, and a selection key is provided for selecting whether to rotate the inner tub or to stop the inner tub in execution of the air wash. The treating tub includes an opening for loading and unloading the clothes and a lid for opening and closing the opening, and the washing machine has a locking means for locking the lid in a closed state until a constant time elapses when the air wash is interrupted or stopped.

A washing machine including: a treating tub storing clothes, for washing, spin-drying and drying the stored clothes; a circulating air duct for extracting air in the treating tub from one end and returning the same into the treating tub from another end in drying; a blowing means provided in the circulating air duct for circulating the air in the circulating air duct from the end to the other end; and a heating means provided in the circulating air duct for heating the air circulated in the circulating air duct, the washing machine comprising: an ozone generation means connected to the circulating air duct for generating ozone by discharge so that the generated ozone is supplied to the circulating air duct in accordance with operation of the blowing means; a command key for instructing execution of air wash; and an air wash execution control means for operating the blowing means, the ozone generation means and the heating means in a predetermined mode in response to the instruction from the command key.

The air wash execution control means operates the blowing means and the heating means and intermittently operates the ozone generation means at a prescribed time interval in response to the instruction from the command key.

The treating tub has an outer tub and an inner tub rotatably provided in the outer tub, and the washing machine includes a motor for rotating the inner tub, and a selection key is provided for selecting whether to rotate the inner tub or to stop the inner tub in execution of the air wash. The treating tub includes an opening for loading and unloading the clothes and a lid for opening and closing the opening, and the washing machine has a locking means for locking the lid in a closed state until a constant time elapses when the air wash is interrupted or stopped.

A washing machine comprising: a treating tub storing clothes, for washing and spin-drying the stored clothes; an ozone generation means for generating ozone by discharge; a supply means for supplying the ozone generated by the ozone generation means into the treating tub; a command key for instructing execution of mold guard; and a mold guard execution control means for operating the ozone generation means and the supply means in a predetermined mode in response to the instruction from the command key.

The treating tub has an outer tub and an inner tub rotatably provided in the outer tub, the washing machine includes a motor for rotating the inner tub, and the mold guard execution control means operates the motor so that the inner tub repeats normal rotation and reverse rotation at a prescribed speed along with the operation of the supply means.

The washing machine including a heating means for heating a feed passage for the ozone or the treating tub, wherein the mold guard execution control means operates the supply means, the heating means and the ozone generation means in response to the instruction from the command key, stops the ozone generation means when a first time elapses, and thereafter stops the supply means and the heating means when a second time further elapses.

A washing machine including: a treating tub storing clothes, for washing, spin-drying and drying the stored clothes; a circulating air duct for extracting air in the treating tub from one end and returning the same into the treating tub from another end in drying; a blowing means provided in the circulating air duct for circulating the air in the circulating air duct from the end to the other end; and a heating means provided in the circulating air duct for heating the air circulated in the circulating air duct, the washing machine comprising: an ozone generation means connected to the circulating air duct for generating ozone by discharge so that the generated ozone is supplied to the circulating air duct in accordance with operation of the blowing means; a command key for instructing execution of mold guard; and a mold guard execution control means for operating the blowing means, the ozone generation means and the heating means in a predetermined mode in response to the instruction from the command key.

The mold guard execution control means operates the blowing means, the heating means and the ozone generation means in response to the instruction from the command key, stops the ozone generation means when a first time elapses, and thereafter stops the blowing means and the heating means when a second time further elapses.

The treating tub has an outer tub and an inner tub rotatably provided in the outer tub, the washing machine includes a motor for rotating the inner tub, and the mold guard execution control means operates the motor so that the inner tub repeats normal rotation and reverse rotation at a prescribed speed along with the operation of the blowing means.

DETAILED DESCRIPTION OF THE INVENTION

Figure 1:
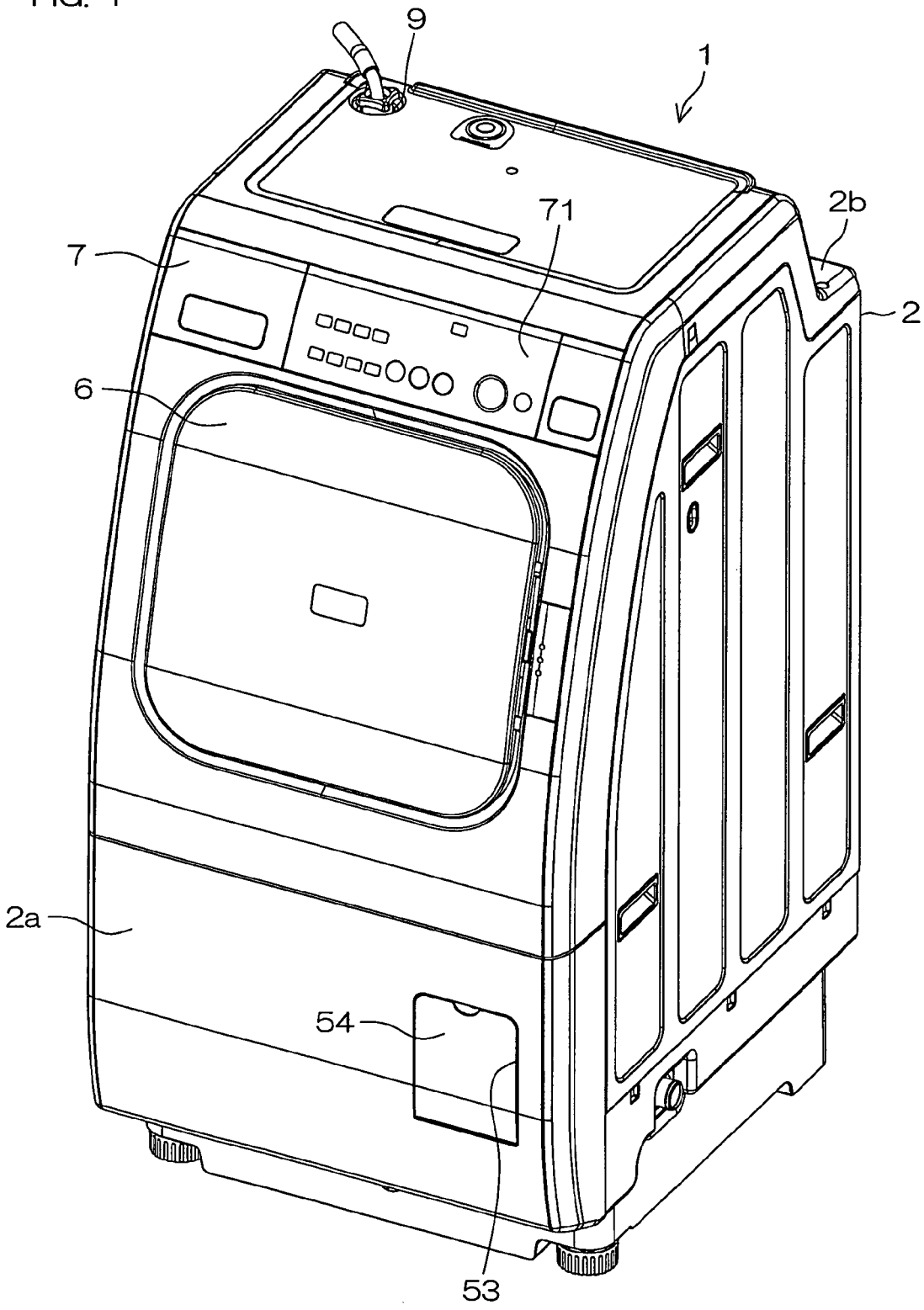
FIG. 1 is a perspective view of a washing machine according to an embodiment of the present invention, as viewed obliquely from the upper right front.

According to the invention, air containing the ozone can be supplied to the clothes stored in the treating tub and to be sterilized/deodorized, and bacteria and the like adhering to the clothes can be eliminated and the clothes can be deodorized with the ozone.

According to the present invention, sterilization/deodorization of the clothes mentioned above with the ozone is referred to as air wash. This is because the clothes are sterilized/deodorized with the air containing the ozone as though they were washed.

The air wash is a treatment performed when the dedicated command key is pressed, and isolated from washing and spin-drying. Therefore, the clothes can be sterilized/deodorized regardless of washing and spin-drying.

The air wash is preferably performed by operating the blowing means and intermittently operating the ozone generation means thereby supplying the air containing a proper quantity of ozone to the clothes. Thus, the clothes are sterilized/deodorized with the ozone. Since the quantity of the ozone is not excessive, the ozone disappears in a short time.

A treating tub of a washing machine generally has an outer tub and an inner tub rotatably provided in the outer tub. The inner tub is rotated in washing and spin-drying.

On the other hand, whether to rotate or stop the inner tub can be selected in execution of the air wash. If the clothes to be sterilized/deodorized are the so-called delicate clothes that may easily fray or lose shape, therefore, the air wash can be performed while rotation of the inner tub is in a stopped state.

On the other hand, clothes free from fraying or losing shape can be efficiently sterilized/deodorized by rotation of the inner tub.

The lid of the treating tub may be locked in the closed state until the constant time elapses when the air wash is interrupted or stopped.

In the air wash, the ozone generated by the ozone generation means is supplied to the clothes to sterilize and deodorize the clothes. Therefore, the ozone is present in the treating tub.

When the air wash is interrupted or stopped, the ozone may present in the treating tub, and the treating tub may be filled with ozone exceeding specified concentration influential with the human body, as the case may be.

The ozone in the treating tub disappears with time due to oxidation. Therefore, the lid of the treating tub is locked in the closed state until the constant time elapses, so that the treating tub is unopenable. Thus, the concentrated ozone in the treating tub can be prevented from leaking out of the treating tub.

The air wash is interrupted or stopped when an operation stop button of the washing machine is pressed or the power supply is cut off.

When the operation stop button is pressed, the lid of the treating tub is kept unopenable until the constant time elapses for preventing the ozone from leaking out of the treating tub.

When the power supply is cut off, e.g., when the plug is pulled out of the socket by mistake or the electricity is cut off the other hand, a built-in control (CPU or memory) counts the time from this point. The lid is kept in the locked state so that the same is unopenable until the specified time elapses.

When the lid is locked in the closed state, the remaining time up to the time when the lid can be opened is preferably indicated on a display portion, for example.

For example, a message such as "The lid is locked until ozone disappears. You can open the lid in XX minutes." or only the remaining time is preferably displayed.

The time for the ozone less than the specified concentration is preferably varied with the operating time of the ozone generation means. Assuming that Ton (operating time of the ozone generation means)=Toff (deozonization time), for example, the maximum time of Toff can be set to 10 minutes, for example.

Thus, the time for locking the lid in the closed state can be minimized, while the noxious ozone can be prevented from leaking out of the treating tub and ozonic smell can be prevented from drifting when the lid is opened.

According to the invention, sterilization/deodorization efficiency for the clothes is improved. This is because the ozone is activated by the heating. If the heating means is operated in execution of the air wash in order to heat the ozone used for the air wash, therefore, the ozone is supplied into the heated atmosphere, and the ozone can be activated.

Bacteria and the like adhering to the clothes can be eliminated and the clothes can be deodorized with the ozone by supplying the air containing the ozone to the clothes stored in the treating tub and to be sterilized/deodorized.

The air wash is performed when the dedicated command key is pressed, so that the clothes can be sterilized/deodorized regardless of washing and drying of the clothes after the washing.

The air wash is preferably performed by operating the blowing means and the heating/generating means and intermittently operating the ozone generation means thereby supplying the air containing a proper quantity of ozone to the clothes. Thus, the clothes are sterilized/deodorized with the ozone. Since the quantity of the ozone is not excessive, the ozone disappears in a short time. The heating means is preferably set to "low temperature", if the temperature can be switched between "high temperature" and "low temperature". This is because the temperature of the clothes is not excessively increased.

Whether to rotate or stop the inner tub can be selected in execution of the air wash. If the clothes to be sterilized/deodorized are the so-called delicate clothes that may easily fray or lose shape, the air wash can be performed while rotation of the inner tub is in a stopped state.

On the other hand, clothes free from fraying or losing shape can be efficiently sterilized/deodorized by rotation of the inner tub.

The lid of the treating tub is locked in the closed state until the constant time elapses when the air wash is interrupted or stopped. Thus, the concentrated ozone in the treating tub can be prevented from leaking out of the treating tub, similarly to the invention described above.

The inner and outer walls of the treating tub can be sterilized/deodorized with the ozone and growth of mold can be prevented even if water deposit, soap scum and the like adhere to the inner and outer walls of the treating tub (the inner wall of the outer tub and the inner and outer walls of the inner tub) to easily grow mold. According to the present invention, therefore, sterilization/deodorization of the treating tub and the like with the ozone is referred to as mold guard.

The mold guard is a treatment performed when the dedicated command key is pressed, and isolated from the treatment in the case where the clothes are stored. The mold guard is a dedicated treatment automatically performed on the basis of operation of the user pressing the command key every lapse of a constant period, e.g., once a month, so that no mold is grown in the treating tub.

In the mold guard treatment, the motor is preferably operated so that the inner tub repeats normal rotation and reverse rotation. This is because the air containing the ozone fully and smoothly spreads between the inner surface of the outer tub and the outer surface of the inner tub opposed to the inner surface of the outer tub, and the treating tub can be more effectively sterilized/deodorized.

During the mold guard treatment, the heating means is preferably operated as described above. The treating tub is sterilized/deodorized with the ozone until the first time elapses. At this time, the air is heated by the heating means, whereby the sterilization/deodorization with the ozone is promoted. The heating means is preferably set to "high temperature", if the temperature can be switched between "high temperature" and "low temperature". This is because the treating function of the ozone is promoted by increasing the temperature of the air.

After the mold guard is executed, the water deposit, soap scum and the like coming off from the treating tub due to the execution of the mold guard can be cleanly washed out by reserving water in the treating tub, rinsing the treating tub with the water (rinse the inner tub and the outer tub with the water by rotating the inner tub included in the treating tub), discharging the water and performing the so-called spin-drying by rotating the inner tub at a high speed.

The treatment of the mold guard can be performed in the washing machine having the drying function, so that the inner and outer walls of the treating tub, the inner wall of the circulating air duct and the like are sterilized/deodorized with the ozone, and growth of mold is prevented even if water deposit, soap scum and the like adhere to the inner and outer walls of the treating tub, the inner wall of the circulating air duct and the like to easily grow mold.

The mold guard treatment is performed by operating the blowing means, the heating means and the ozone generation means and circulating the air containing the ozone in the treating tub and the circulating air duct. Thus, the treating tub and the circulating air duct are sterilized/deodorized with the ozone before the first time elapses. The air is heated by the heating means, whereby the sterilization/deodorization with the ozone is promoted. The heating means is preferably set to "high temperature", if the temperature can be switched between "high temperature" and "low temperature". This is because the treating function of the ozone is promoted by increasing the temperature of the air.

The inner tub repeats normal rotation and reverse rotation during the mold guard treatment, the air containing the ozone fully and smoothly spreads between the inner surface of the outer tub and the outer surface of the inner tub opposed to the inner surface of the outer tub, and the treating tub can be more effectively sterilized/deodorized, similarly to the invention described above.

A full automatic drum-type washing machine is now described as an embodiment of the present invention, with reference to the drawings.

FIG. 1 is a perspective view of a washing machine according to an embodiment of the present invention, as viewed obliquely from the upper right front.

The outer shell of this washing machine 1 constitutes a housing 2 slightly long in the vertical direction. A water inlet 9 is provided on the upper surface of the housing 2, and water supply equipment such as waterworks is connected to this water inlet 9. An operation panel 71 is arranged on a front upper portion of the housing 1. The user can desiredly drive the washing machine 1 by operating the operation panel 71.

A storage portion 7 for storing a detergent and a softening agent is arranged drawably on the left side of the operation panel 71.

The lower portion of the front surface of the housing 2 is upright, and the front surface is loosely inclined backward from an intermediate position, as viewed from below. A door 6 is provided on a raised portion to the center of the front surface. The door 6 is in the form of a square having rounded corners as viewed from the front side, and includes a circular seal packing (not shown) for sealing an outer tub 5 described later.

An independently detachable front panel 2*a* is provided on the lower portion of the front surface of the housing 2. When the front panel 2*a* is detached, the lower front portion of the washing machine 1 is exposed and maintenance of a pump, changeover valves and a filter (these are described later) provided on the lower front portion can be easily performed.

Further, a window 53 is formed on the right side of the front panel 2*a*, and the window 53 is covered with a lid 54. When the lid 54 is detached, the filter (described later) is exposed so that lint etc. captured by the filter can be easily removed.

A rear portion of the upper surface of the housing 2 forms a sunken surface 2*b* lowered by one step. The housing 2 is relatively high, so that the upper portion of the housing 2 may interfere with a water tap or the like when this washing machine 1 is to be installed. Therefore, the sunken surface 2*b* is formed on the rear portion of the upper surface, so that the washing machine 1 can be arranged with no hindrance even if the water tap is provided on a low position.

Figure 2:
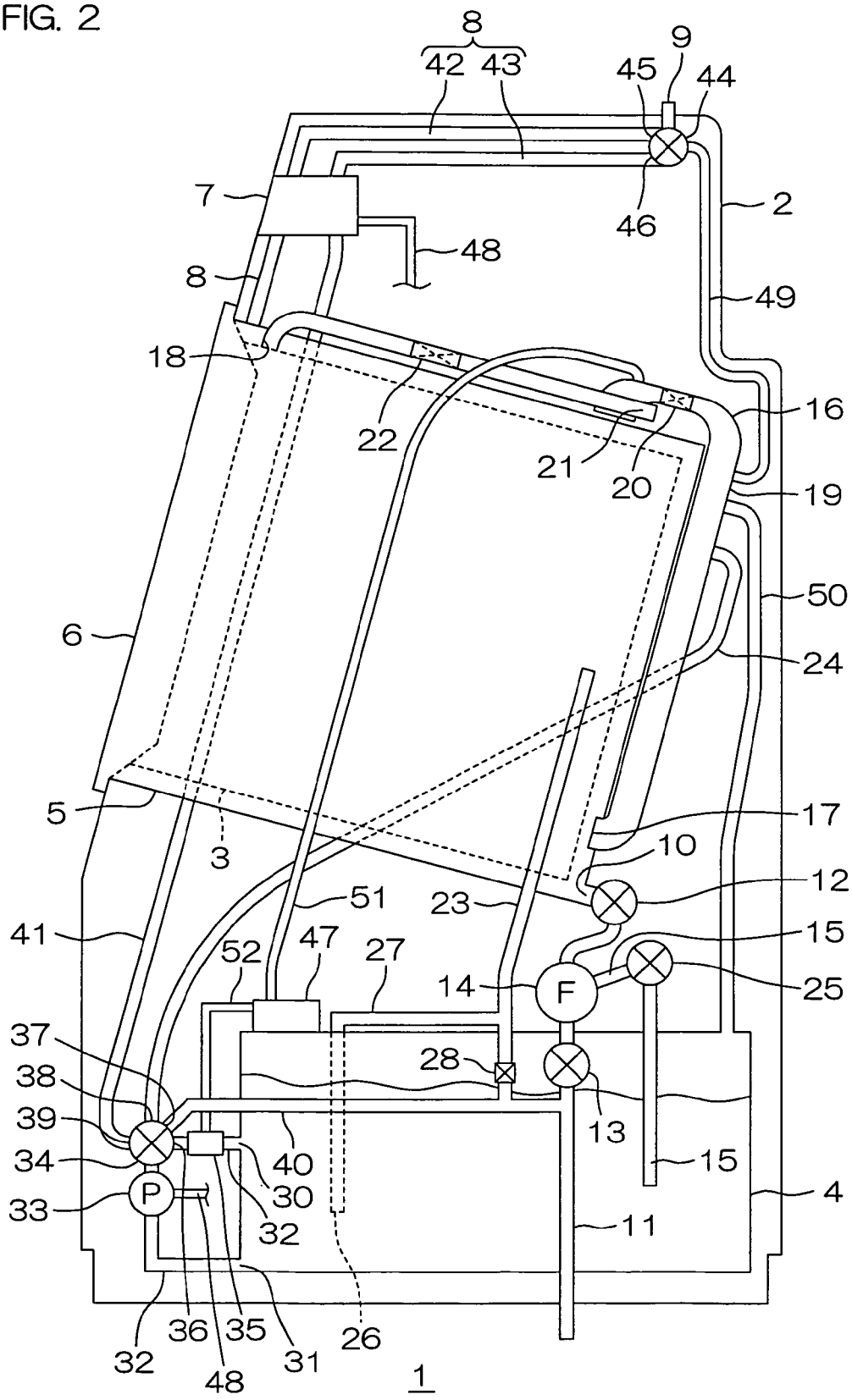
FIG. 2 is a schematic sectional side view showing a section of the washing machine according to the embodiment of the present invention sectioned along a vertical plane along the anteroposterior direction as viewed from a side portion.

FIG. 2 is a schematic sectional side view showing a section of the washing machine according to the embodiment of the present invention sectioned along a vertical plane along the anteroposterior direction as viewed from a side portion. In relation to the washing machine 1 according to this embodiment and the structural elements (structural components) thereof, the following description is made based on the definition that the left side in FIG. 2 is the front surface (front) side of the washing machine, the right side is the rear surface (rear) side, the upper side is the upper surface (upper) side, the lower side is the bottom surface (lower) side, the front side is the right side, and the rear side is the left side, respectively.

A drum 3 is arranged at the center in the housing 2.

The drum 3 is in the form of a cylinder, and coaxially stored in the identically cylindrical outer tub 5. According to this embodiment, the drum 3 and the outer tub 5 constitute a washing tub (treating tub), and the front portion of the drum 3 is directed obliquely upward to provide a so-called inclined drum arrangement structure. The front end surfaces of the drum 3 and the outer tub 5 are open, and the door 6 is provided on the front surface of the housing 2 in order to block the same. A motor (though not appearing in FIG. 2, this motor is a motor 62 in FIG. 4) is provided at the back of the rear end surface of the outer tub 5, and the drum 3 is rotated by the motor about the central axis of the drum 3.

A water pipe 8 arranged in the housing 2 is connected to the water inlet 9 provided on the upper surface of the housing 2 through a first changeover valve 44 which is a four-way valve. Another end of the water pipe 8 opposite to the end connected to the water inlet 9 is connected to the uppermost portion of the peripheral wall of the outer tub 5, and the water inlet 9 and the outer tub 5 communicate with each other through the water pipe 8. The storage portion 7 for storing the detergent and the softening agent is arranged on an intermediate position of the water pipe 8.

The storage portion 7 has a box (not shown) drawable frontward from the housing 2, and the box is partitioned into a detergent storage chamber and a softening agent storage chamber. The box is drawn, the detergent and the softening agent are stored in the respective chambers, and the box is shoved, so that the detergent and the softening agent are completely set. When water is supplied to the storage portion 7 through the water pipe 8, the detergent and/or the softening agent stored in the detergent storage chamber and the softening agent storage chamber respectively is dissolved in the water supplied through the water pipe 8 and supplied into the outer tub 5. It is also selectively possible to supply the outer tub 5 with water in which the detergent and/or the softening agent is not dissolved.

An end of a priming pipe 48 is connected to a vertical intermediate position of the rear side surface of the storage portion 7. The other end of the priming pipe 48 is connected to a supply pump 33 provided in the housing 2, to supply priming from the storage portion 7 to the supply pump 33 when the supply pump 33 is driven in the housing 2 to draw water.

The water pipe 8 branches into a detergent water pipe 42 and a softening agent water pipe 43 at the first changeover valve 44, while the detergent water pipe 42 and the softening agent water pipe 43 join each other at the storage portion 7.

The first changeover valve 44 includes an inlet the water from the water inlet 9 enters, a detergent water outlet 45 linked to the detergent water pipe 42 and a softening agent water outlet 46 linked to the softening agent water pipe 43.

Therefore, it is selectively possible to feed the water entering from the inlet of the first changeover valve 44 from the detergent water outlet 45 to the detergent storage chamber of the storage portion 7 mentioned above through the detergent water pipe 42, or from the softening agent water outlet 46 to the softening agent storage chamber of the storage portion 7 through the softening agent water pipe 43 by switching the first changeover valve 44.

To specifically describe washing and spin-drying, the door 6 is opened and clothes to be washed is loaded into the drum 3 from the front side of the housing 2 in the washing machine 1 in a washing step.

After the door 6 is closed, water is reserved in the outer tub 5. While the outer tub 5 is constituted in an airtight and fluid-tight manner, a large number of pores are formed on the peripheral surface of the drum 3. When the water is reserved in the outer tub 5, therefore, the reserved water also enters the drum 3, so that the water for washing is reserved also in the drum 3.

A baffle (not shown) is protrusively provided on a proper portion of the inner peripheral surface of the drum 3. When the drum 3 is rotated by the motor, the water-containing clothes in the drum 3 are lifted by the baffle and subjected to a so-called beat washing with gravity drop. When the washing step is ended, the water is discharged from the outer tub 5.

A backwardly open drain port 10 is formed on the lowermost end, i.e., the lower portion of the rear end surface of the outer tub 5, and a drain valve 12 is mounted on the rear side thereof. A downwardly extending drainpipe 11 is connected to the drain valve 12, and a filter 14 and a second changeover valve 13 are interposed on an intermediate position thereof in this order. A branch pipe 15 is connected to the filter 14 independently of the drain pipe 11, and it is possible to select whether the water passing through the filter 14 is discharged to the housing 2 continuously along the drain pipe 11, or flown into the branch pipe 15 by switching the second changeover valve 13.

The drain port 10 and the drain valve 12 can be positioned generally equal to the height of the lowermost end of the outer tub 5 by opening the drain port 10 toward the rear portion of the outer tub 5 and arranging the drain valve 12 at the back thereof. Thus, the drain port 10 and the drain valve 12 do not enter the arrangement space for various structural elements arranged under the outer tub 5, but the arrangement space for the various structural elements can be widely ensured. Particularly when the washing machine 1 is operated, the outer tub 5 vibrates. Accordingly, the drain valve 12 also vibrates in accordance with the vibration of the outer tub 5 if the drain port 10 and the drain valve 12 fixed to the outer tub 5 protrude downward beyond the outer tub 5. Therefore, the lower space must be ensured in consideration of this vibration. According to this embodiment, the drain port 10 and the drain valve 12 are arranged utilizing the rear portion of the outer tub 5, whereby the lower space of the outer tub 5 can be excellently used for arranging the other structural elements.

When the drain valve 12 and the second changeover valve 13 are turned "open", the water in the outer tub 5 is discharged from the housing 2. When the drain valve 12 is turned "open" and the second changeover valve 13 is turned "closed", on the other hand, the water in the outer tub 5 flows out to the branch pipe 15 through the filter 14.

After the water in the outer tub 5 is discharged, a rinsing step is carried out. In the rinsing step, the drain valve 12 is closed again, water is reserved in the outer tub 5 similarly to the washing step mentioned above, and rinsing is performed by rotating the drum 3 with the motor.

When the rinsing step is ended, the rotation of the drum 3 is stopped, and the water in the outer tub 5 is discharged from the housing 2, similarly to the water discharge operation mentioned above.

In a spin-drying step, the drum 3 is spin-dry-rotated (high-speed-rotated) by the motor, and moisture contained in the clothes is eliminated. In the washing machine 1 according to this embodiment, the spin-drying is performed to gradually start up the rotation of the drum 3, so that the drum 3 is not abnormally vibrated due to uneven distribution of the clothes on the inner peripheral wall of the drum 3 during the spin-drying.

In the washing machine 1 according to this embodiment, washing, spin-drying and drying are performed in the order of washing step, first spin-dying step, first rinsing step, second spin-drying step, second rinsing step, final spin-drying step, and drying step.

In other words, an outlet 17 of a dry air duct 16 as a circulating air duct is connected to the lower portion of the rear end surface of the outer tub 5, so that the washing machine 1 can perform drying in addition to the washing and the spin-drying. The outlet 17 is provided with a temperature sensor measuring the temperature of the outlet 17. The dry air duct 16 extends obliquely upward along the rear end surface of the outer tub 5, reaches the front side along the upper portion of the outer tub 5 and extends frontward along the upper peripheral surface of the outer tub 5, and the front end thereof is connected to the front peripheral surface of the outer tub 5 as an inlet 18. The region of this dry air duct 16 extending obliquely upward along the rear end surface of the outer tub 5 functions as a dehumidifying pipe 19 as a dehumidifying means.

In the dry air duct 16, a filter 20 is inserted inside on the downstream side of the dehumidifying pipe 19 as viewed along the air flowing direction, and a blower 21 as a blowing means is provided on the further downstream side thereof. The blower 21 is rotated, so that the air in the drum 3 is released from the outlet 17, moved in the dry air duct 16, and supplied into the drum 3 again from the inlet 18. A heater 22 as a heating means is inserted inside on the downstream side of the blower 21 in the dry air duct 16. The heater 22 includes two heaters, i.e., a heater A and a heater B. Only the heater A is so energized, so that heating is performed as "low", while the two heaters A and B are energized, so that heating is performed as "high". The air passing through the dry air duct 16 is dehumidified in the dehumidifying pipe 19, thereafter heated by the heater 22, and supplied to the drum 3 from the inlet 18.

The clothes are showered with the air heated by the heater 22, so that the moisture contained in the clothes is vaporized into steam, and the hot and humid air in the drum 3 containing this steam is released from the outlet 17 and moves upward in the dehumidifying pipe 19. At this time, water supplied through a heat exchanger water pipe 49 is dropped in the dehumidifying pipe 19. More specifically, an end of the heat exchanger water pipe 49 is connected to the first changeover valve 44, and the other end thereof is connected to the upper portion of the dehumidifying pipe 19. Therefore, the first changeover valve 44 is switched, so that the water from the water inlet 9 is dropped into the dehumidifying pipe 19 through the heat exchanger water pipe 49. Independently of the heat exchanger water pipe 49, water can be supplied into the dehumidifying pipe 19 also through a heat exchanger tank water pipe 24. The structure of the heat exchanger tank water pipe 24 is described later.

When the water is dropped in the dehumidifying pipe 19, the hot and humid air performs heat exchange, so that the hot and humid air is cooled and dehumidified. The water from the heat exchanger water pipe 49 or the heat exchanger tank water pipe 24 and moisture liquefied upon dehumidification drop in the dehumidifying pipe 19, thereafter reach the drain port 10 through the outlet 17, and are discharged from the housing 2 when the drain valve 12 and the second changeover valve 13 are opened.

A tank 4 is provided under the drum 3. This tank 4 is a tank having a closed structure, for reserving the water reserved in the outer tub 5 and used thereafter. In order to guide the water from the outer tub 5 to the tank 4, the other end of the branch pipe 15 opposite to the end connected to the filter unit 14 opens in the tank 4. More specifically, a water storage valve 25 is interposed in an intermediate position of the branch pipe 15. The branch pipe 15 extends obliquely upward from the filter 14 toward the water storage valve 25 in the range from the filter 14 up to the water storage valve 25, and extends downward from the water storage valve 25 to pass through the upper surface of the tank 4. The other end of the branch pipe 15 is arranged on a vertically intermediate position in the tank 4.

Therefore, the second changeover valve 13 is closed while the drain valve 12 and the water storage valve 25 are opened, so that the water of the outer tub 5 is guided into the tank 4.

An end of an air vent hose 50 is connected to the tank 4. The air vent hose 50 extends upward from the tank 4 through the rear portion of the outer tub 5, and the other end thereof is connected to the upper portion of the dehumidifying pipe 19. Thus, the tank 4 and the dry air duct 16 communicate with each other.

The tank 4 includes a pressure-regulating drainpipe 27 having an inlet 26 opening in the tank 4. A check valve 28 is interposed into an intermediate position of the pressure-regulating drainpipe 27. An outlet side of the pressure-regulating drainpipe 27 joins the drainpipe 11 on the further downstream side of the second changeover valve 13.

An overflow pipe 23 is connected to the pressure-regulating drainpipe 27. When water is supplied into the outer tub 5 exceeding a prescribed quantity, the water exceeding the prescribed quantity overflows the outer tub 5 through the overflow pipe 23, and is discharged from the machine through the drainpipe 11.

The tank 4 is provided with a circulating pipe 32 connecting an outlet 31 and an inlet 30 formed on the side portion thereof, in order to circulate the water reserved in the tank 4. The supply pump 33, a third changeover valve 34 and an ejector 35 are inserted into the circulating pipe 32 successively from the outlet 31 toward the inlet 30 along the circulating direction of the water.

The third changeover valve 34 is a five-way valve, and has a first outlet 36, a second outlet 37, a third outlet 38 and a fourth outlet 39, in order to switch the water discharged from the supply pump 33 to flow in from one direction.

The circulating pipe 32 is connected to the first outlet 36, and linked to the inlet 30 through the ejector 35.

A tank water drainpipe 40 is linked to the second outlet 37, and the tank water drainpipe 40 joins the pressure-regulating drainpipe 27 on the further downstream side of the check valve 28.

An end of the heat exchanger tank water pipe 24 mentioned above is connected to the third outlet 38. The other end of the heat exchanger tank water pipe 24 is connected to the upper portion of the dehumidifying pipe 19.

An end of a tank water pipe 41 is linked to the fourth outlet 39, and the other end of the tank water pipe 41 is connected to the water pipe 8 through the storage portion 7.

An ozone generator 47 is provided in the vicinity of the tank 4. The ozone generator 47 is a device generating ozone by applying silent discharge to air incorporated from an air channel (not shown). The air passing through the ozone generator 47 contains the ozone.

According to this embodiment, the air containing the ozone generated in the ozone generator 47 is supplied to the dry air duct 16 through a first feed passage 51. The supplied position is the downstream side of the filter 20 in the air dry duct 16, and the upstream side of the blower 21 (the suction side of the blower 21). When the blower 21 rotates, the suction side thereof has a negative pressure, and the air containing the ozone is sucked into the blower 21 through the first feed passage 51. Therefore, there is no need to provide specific device such as an air pump for discharging the generated ozone, and the ozone generator 47 can be constituted of a simple structure. The ozone is mixed into the air circulated in the dry air duct 16, and supplied into the drum 3 from the inlet 18.

The air containing the ozone generated in the ozone generator 47 is supplied to the ejector 35 by a second feed passage 52. The ozone supplied through the second feed passage 52 is mixed into the circulated water in the tank 4 at the ejector 35. More specifically, the air containing the ozone supplied from the second feed passage 52 is mixed into the water as fine bubbles at the ejector 35 due to a negative pressure generated when the water passes through the ejector 35. If coloring matter, an odor component and bacteria are contained in the water, these are oxidized by the ozone, and the water in the tank 4 is decolorized, deodorized and sterilized.

The outer tub 5 storing the drum 3 has the fluid-tight and airtight structure, and the ozone generated in the ozone generator 47 circulates between the tank 4 and the outer tub 5 due to such a structure that the tank 4 and the outer tub 5 are connected with each other through the overflow pipe 23 and the air vent hose 50, but does not leak out of the housing 2. Thus, this washing machine 1 can be formed as an apparatus having safety and no inconvenience in use with no ozonic smell drifting outward.

Figure 3:
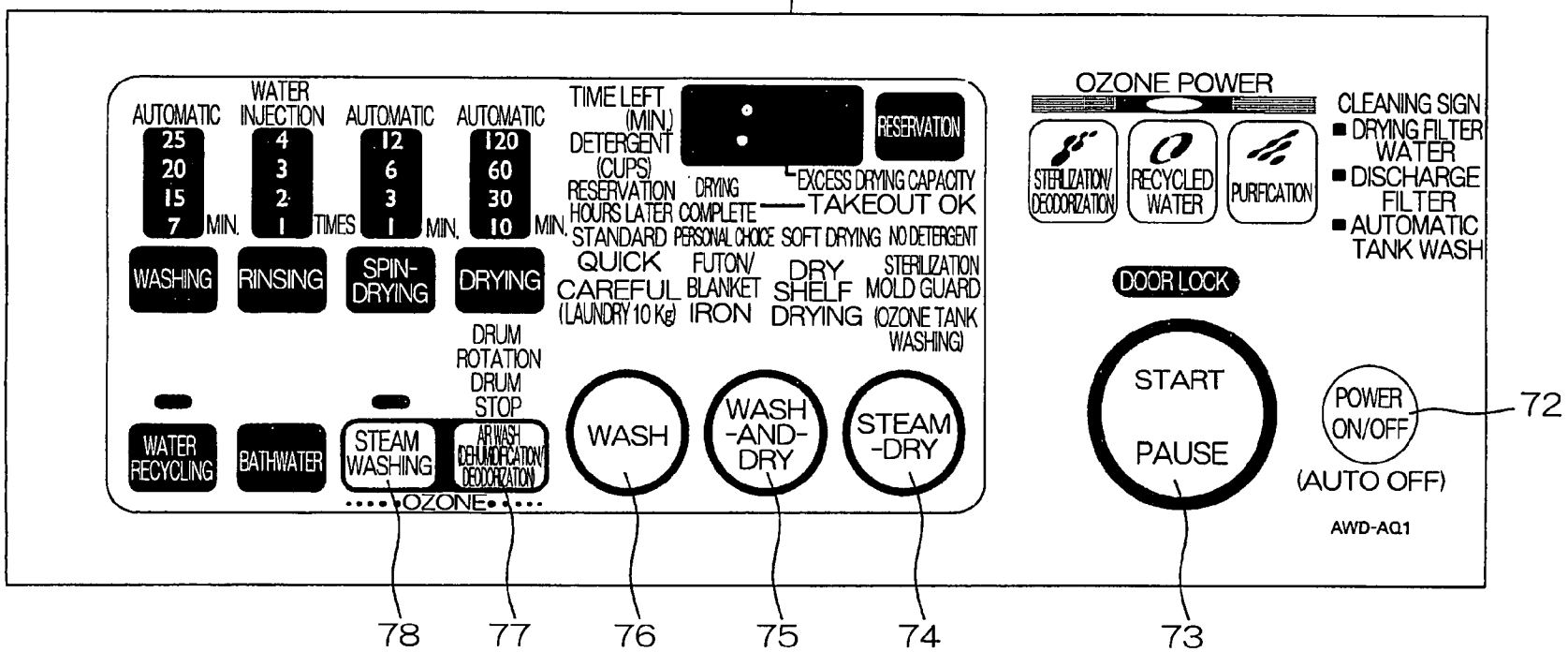
FIG. 3 is a specific plan view showing an example of an operation panel 71 provided on the washing machine 1.

FIG. 3 is a specific plan view showing an example of the operation panel 71 provided on the washing machine 1.

The operation panel 71 is provided with a power on/off key 72 and a start/pause key 73. The power on/off key 72 is a key for supplying/stopping power to the washing machine 1. The start/pause key 73 is a key for instructing start of operation of the washing machine 1 and pause of the operation in a process.

The operation panel 71 is further provided with a steam-dry key 74, a wash-and-dry key 75 and a wash key 76. The steam-dry key 74 is a key pressed when only drying the clothes is performed, i.e., when a drying course is selected. The wash-and-dry key 75 is a key pressed when serial processing from washing up to drying is performed, i.e., when a wash-and-dry course is selected. The wash key 76 is a key pressed when washing and spin-drying are performed but drying is not performed, i.e., when a wash course is selected.

When the wash key 76 is pressed, for example, procedures related to washing among a plurality of procedures displayed in three rows and four columns above the same are successively displayed in turns in response to the pressing. The display is switched downward from the top and rightward from the left, for example. More specifically, the washing contents are successively selected such that "STANDARD" is turned on when the wash key 76 is pressed once, "STANDARD" is turned off and "QUICK" is turned on when the wash key 76 is pressed again, and "QUICK" is turned off and "CAREFUL" is turned on in place when the wash key 76 is further pressed.

When the wash-and-dry key 75 and the steam-dry key 74 are also pressed, procedures related to wash-and-dry operation and procedures related to drying can be successively selected.

Further, an air wash (sterilization/deodorization) key 77 and a steam wash key 78 are provided.

The air wash (sterilization/deodorization) key 77 is a key operated when the clothes need not be washed but smells or the like adsorbed into the clothes are to be removed. When clothes have smell of a cigarette, for example, the clothes are stored in the drum 3 and the air wash (sterilization/deodorization) key 77 is pressed. Then the display is switched such that the "DRUM ROTATION" present above the same is turned on, the "DRUM STOP" is turned on, the "DRUM ROTATION" is turned on in response to the number of the pressing times. Such deodorization/smell elimination treatment of the clothes that the air containing the ozone is supplied into the drum 3 with rotation of the drum 3 when the DRUM ROTATION is turned on while the air containing the ozone is supplied into the drum 3 without rotation of the drum 3 when the DRUM STOP is turned on is performed as a treatment independent of washing and drying. In other words, the air wash (sterilization/deodorization) key 77 is a key for independently performing the treatment when clothes requiring no washing are to be subjected to deodorization/smell elimination.

The steam wash key 78 is a key pressed when steam washing is to be added in washing.

While other keys and various displays indicating operating situations are arranged on the operation panel 71, these are not directly related to the present invention. Therefore, description thereof is omitted.

Figure 4:
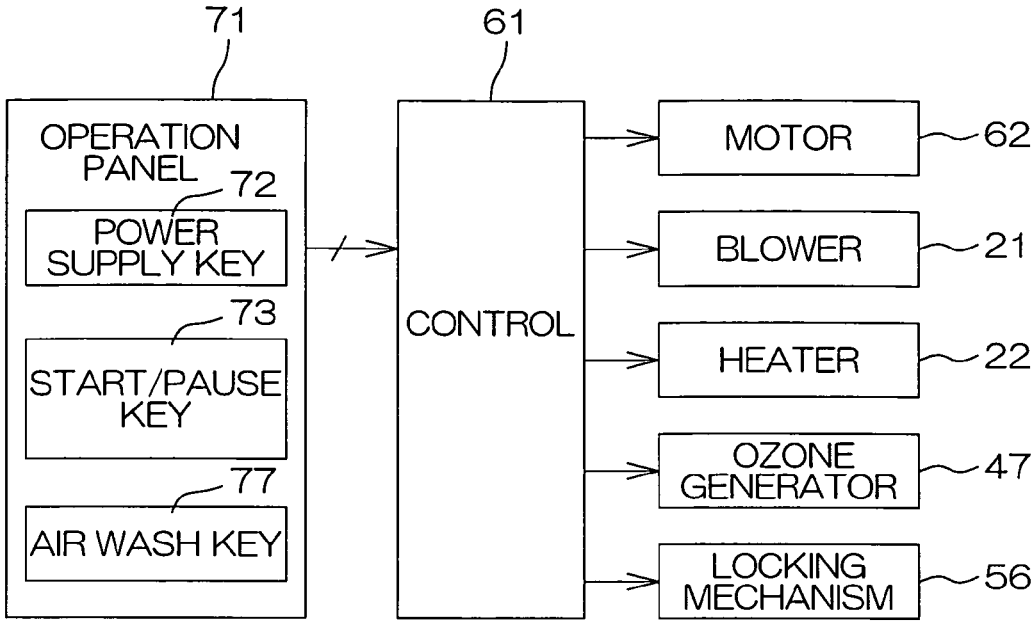
FIG. 4 is a control circuit block diagram of the washing machine 1.

FIG. 4 is a control circuit block diagram of the washing machine 1, and a control block diagram showing only structural elements related to characteristic operation to the present invention.

The washing machine 1 includes a control 61 constituted of a CPU, a ROM, a RAM and the like. Command signals from the power on/off key 72, the start/pause key 73, the air wash (sterilization/deodorization) key 77 and the like provided on the operation panel 71 mentioned above are supplied to the control 61.

The control 61 controls operation of the motor 62, the blower 21, the heater 22, the ozone generator 47 and the locking mechanism 56 in response to the supplied command signals. The control 61 and the locking mechanism 56 correspond to the locking means according to the present invention.

Figure 5:
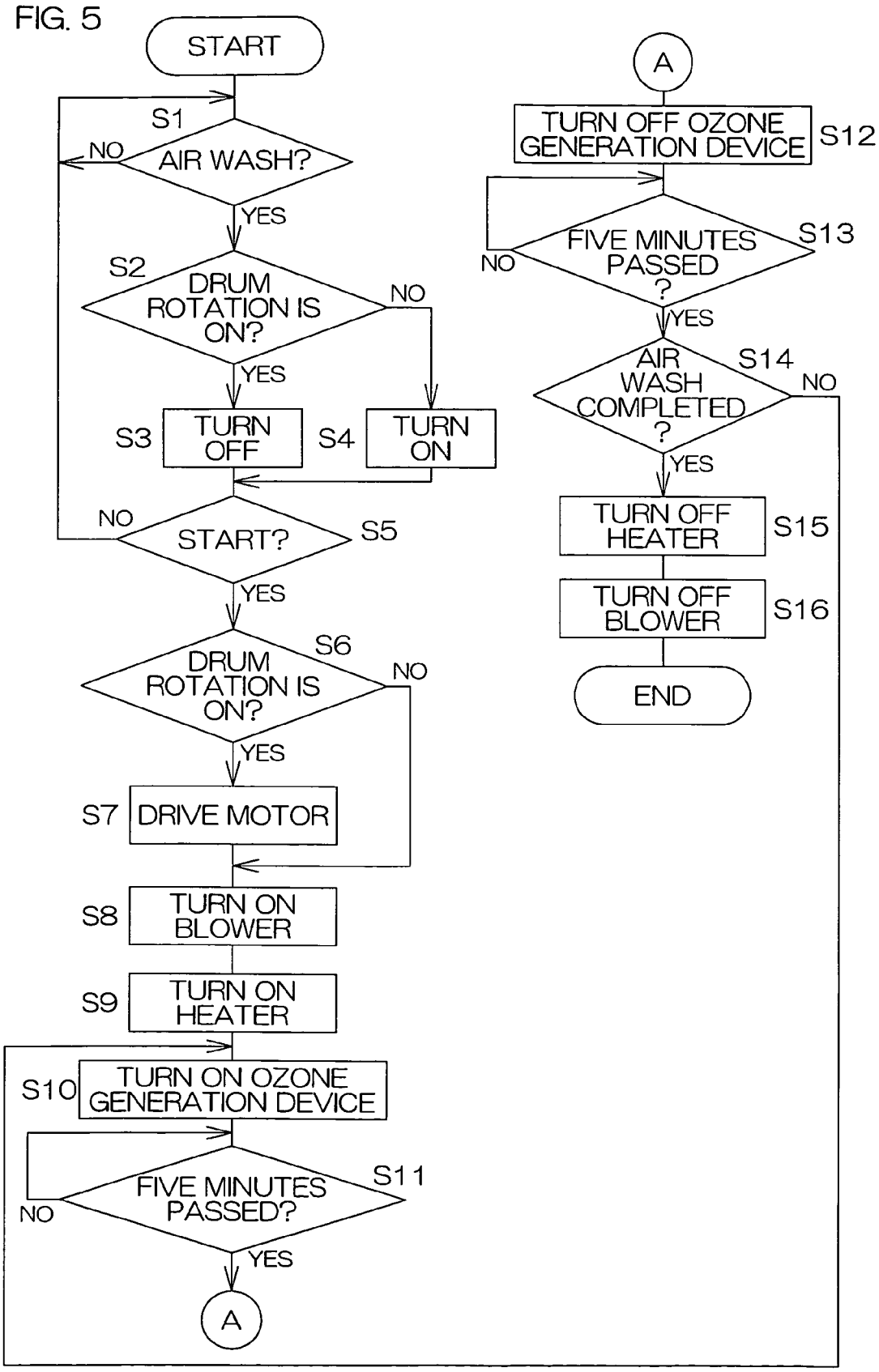
FIG. 5 is a flow chart showing a control operation of an air wash operation performed by a control 61.
Figure 6:
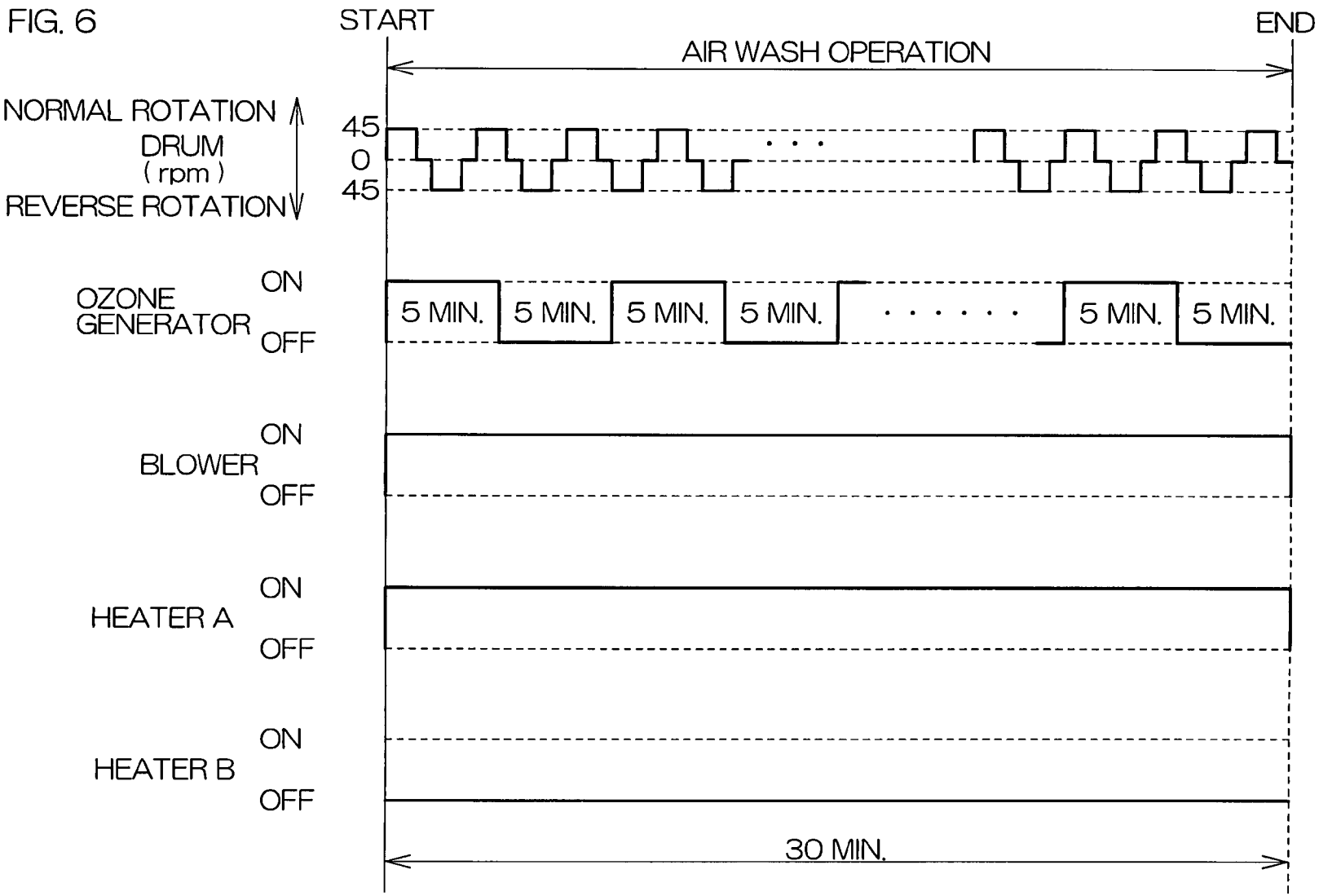
FIG. 6 is a timing chart of the control operation of the air wash operation.

FIG. 5 is a flow chart showing a control operation for the air wash operation performed by the control 61 shown in FIG. 4. FIG. 6 is a timing chart showing the current operation of the drum 3, the ozone generator 47, the blower 21 and the heater 22. The control operation is now described mainly on the basis of the flow chart shown in FIG. 5, with reference to the timing chart shown in FIG. 6.

When the operation starts, the control 61 determines whether or not the air wash key 77 is pressed and a command signal is supplied (Step S1). When the command signal from the air wash key 77 is supplied, the control 61 determines whether or not the "DRUM ROTATION" display is on (Step S2). Then, the display of "DRUM ROTATION" is turned off if the same is on (Step S3), and the "DRUM ROTATION" display is turned on if the same is off (Step S4).

Thereafter the control 61 waits until the start/pause key 73 is pressed and a signal is input (Step S5).

If the air wash key 77 is pressed a plurality of times before the start/pause key 73 is pressed, the display of "DRUM ROTATION" is alternately switched to turn on and off in response to the number of the pressing times. When once the air wash key 77 itself is pressed, the key itself is turned on to display for the user that air wash operation is performed.

When the start/pause key 73 is pressed, the control 61 determines whether or not the "DRUM ROTATION" display is on (Step S6), and normally and reversely rotates the motor to normally and reversely rotate the drum 3 slowly (at 45 rpm, for example) if the "DRUM ROTATION" display is on (Step S7).

If the "DRUM ROTATION" display is off, the motor 62 is not operated. In other words, the air wash operation is performed without rotating the drum 3. It is effective for the so-called delicate clothes that may easily fray or lose shape, when the air wash is performed without rotating the drum 3.

Then, the control 61 turns on the blower 21 (Step S8), and also turns on the heater 22 at the same time (Step S9). While the heater 22 has the two heaters A and B according to this embodiment, only the heater A is energized by the ON-state heater 22 for performing "low" heating. The ozone generator 47 is also turned on (Step S10).

Thus, the air in the drum 3 is circulated through the dry air duct 16, then this air is heated by the heater 22 and mixed with the ozone generated in the ozone generator 47 to be supplied into the drum 3. Therefore, the clothes stored in the drum 3 can be sterilized and deodorized.

If the drum 3 is slowly normally and reversely rotated in such sterilization/deodorization, the clothes stored in the drum 3 are stirred in the drum 3, whereby the clothes are fully exposed to the ozone, and the sterilization/deodorization efficiency is improved.

When the drum 3 is in a stationary state, on the other hand, the clothes stored in the drum 3 remain unmoving, and the air containing the ozone is supplied to the clothes to sterilize/deodorize the clothes. The clothes are completely secure from fray or lose shape following the sterilization/deodorization.

When Step S11 determines an elapse of 5 minutes from the start of the air wash, i.e., after the start/pause key 73 is pressed, the ozone generator 47 is turned off (Step S12), and the operation is continued until 5 minutes further elapse in this state (Step S13).

In other words, the ozone generator 47 is switched between energized and non-energized states at intervals of 5 minutes. Thus, the quantity of the ozone supplied for the air wash can be adjusted to a proper quantity. The on/off time for the ozone generator 47 is an example, and can be set to a time other than the 5-minute interval. Alternatively, the ozone generator 47 can be always kept on.

Then, Step S14 determines as to whether or not to end the air wash operation, and the processing returns to Step S10 to turn on the ozone generator 47 again when the air wash operation is not ended.

According to this embodiment, the air wash operation is to be performed for 30 minutes, for example, and when 30 minutes elapse, termination of the air wash operation is determined at Step S14, the heater 22 (heater A) is turned off (Step S15) and the blower 21 is turned off (Step S16), and the air wash operation is completed.

In the air wash operation, the ozone generator 47 is off for 5 minutes before the completion thereof, so that the air in the drum 3 hardly contains the ozone and the user smells no uncomfortable ozonic smell when opening the door 6 and taking out the clothes from the drum 3 upon completion of the air wash operation.

Figure 7:
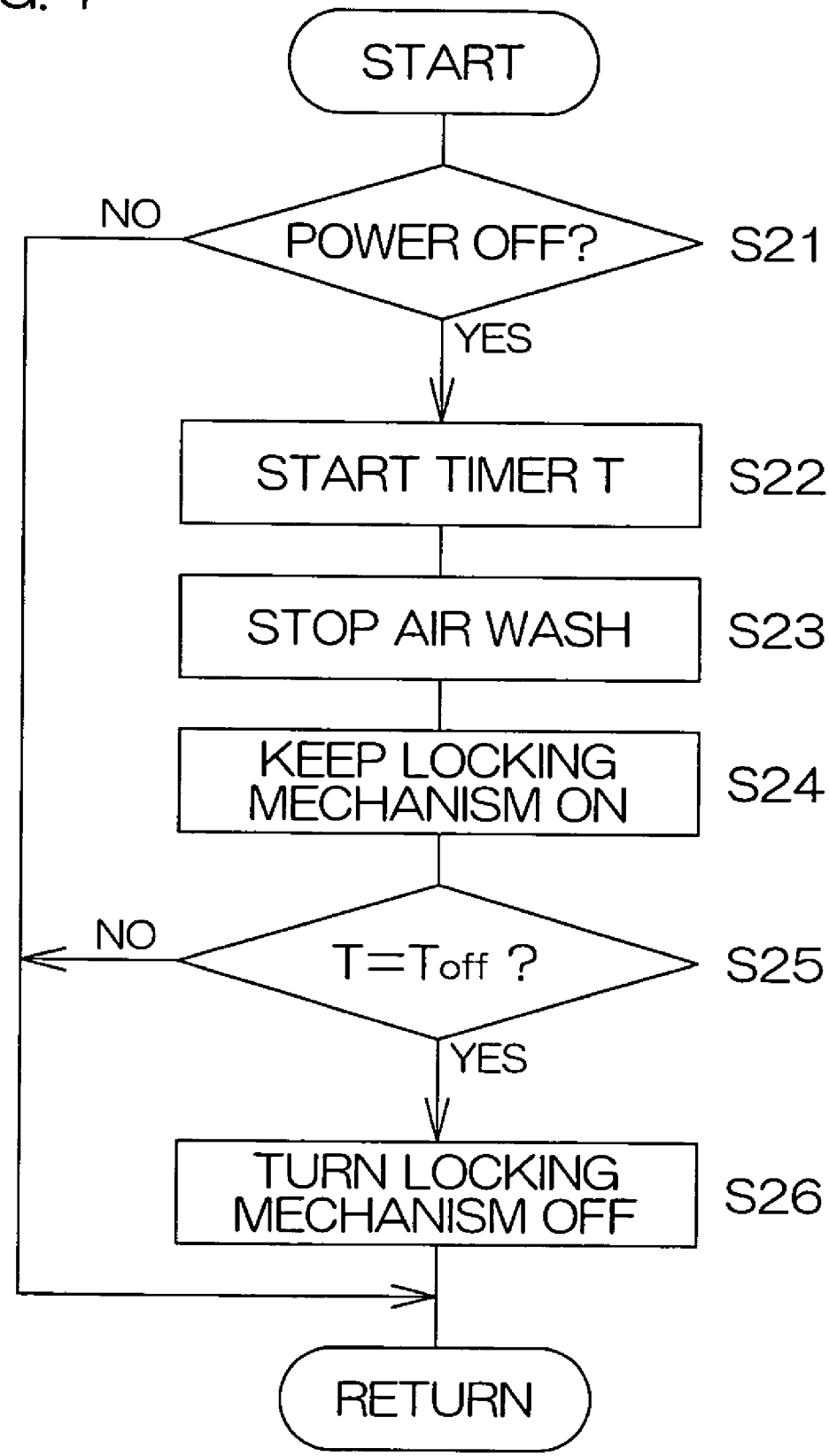
FIG. 7 is a flow chart showing processing by the control 61 in a case where the air wash operation is interrupted or stopped during processing.

FIG. 7 is a flow chart showing processing performed by the control 61 when the power on/off key 72 is pressed to shut off the power supply, the power supply is shut off by power outage or the like or the start/pause key 73 is pressed to pause the operation in a process of the air wash operation.

When the shut off of the power supply is determined in a process of the air wash operation (YES at Step S21), the control 61 stops the air wash operation (Step S22), starts a timer (Step S23), keeps the locking mechanism 56 on (Step S24), and maintains this state until a constant time elapses (Step S25).

During the air wash operation, the drum 3 and the dry air duct 16 are filled with the ozone, and may be filled with concentrated ozone gas which must not leak out of the machine as the case may be.

Therefore, the locking mechanism 56 locks the door 6 in a closed state with the start of the air wash operation, while the locking mechanism 56 is kept on to keep the door 6 unopenable, so that the user still cannot open the door 6 after the stop of air wash.

The ozone in the drum 3 and the dry air duct 16 is oxidized and attenuated in concentration with time to eventually disappear.

When the constant time elapses, the control 61 releases the locking mechanism 56 (Step S26), and ends the processing.

The constant time determined at the Step S25 is desirably set to the time of energization of the ozone generator 47, i.e., the ozone generation time.

Assuming that Ton represents the energization time for the ozone generator 47 and Toff represents the time (deozonization time) for locking the door, these times are preferably set that Ton=Toff.

In consideration of the volumes of the outer tub 5 and the dry air duct 16 as well as the quantity of ozone generation in the ozone generator 47 in this washing machine 1, the maximum time of Toff (deozonization time) can be suppressed to about 10 minutes.

Thus, the time when the door 6 is unopenable can be set to not more than 10 minutes, and the time when the clothes in the drum 3 cannot be taken out can be minimized in a case where the user shuts off the power supply by mistake or the electricity is cut off.

The washing machine 1 according to this embodiment can further perform "MOLD GUARD" operation for preventing or suppressing mold to grow in the drum 3, the outer tub 5, the dry air duct 16 and the like with the ozone.

The mold guard operation can be set by pressing the wash key 76 mentioned above (see FIG. 3). Referring to FIG. 3, the wash key 76 is pressed a prescribed number of times that "MOLD GUARD (ozone tank washing)" displayed above the same can be selected and displayed. When the start/pause key 73 is pressed in this state, the mold guard operation is executed.

The mold guard operation may not be selected with the wash key 76 as in this embodiment, but a dedicated command key for setting the mold guard may be provided similarly to the air wash operation.

Figure 8:
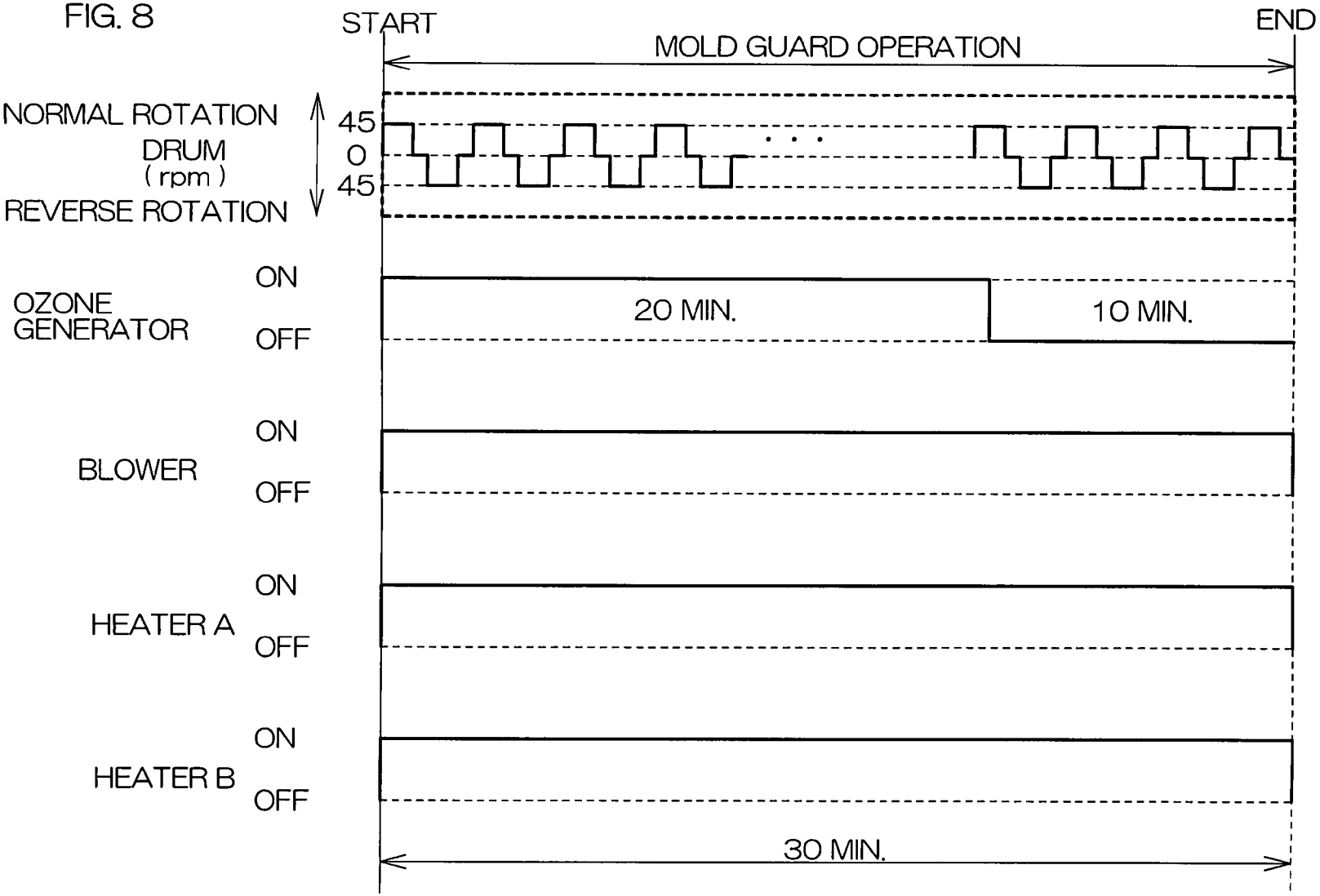
FIG. 8 is a timing chart of a mold guard operation.

FIG. 8 is a timing chart showing operation of the drum 3, the ozone generator 47, the blower 21 and the heater 22, for illustrating the contents of the mold guard operation.

When the mold guard operation is started, the drum 3 is normally and reversely rotated slowly (at 45 rpm, for example). Further, the ozone generator 47, the blower 21 and the heater 22 are turned on. In the mold guard operation, both of the heaters A and B included in the heater 22 are turned on, so that heating is performed "high".

For 20 minutes after the start of the mold guard operation, the ozone generated by the ozone generator 47 is supplied, and the air containing the ozone is circulated between the drum 3 and the outer tub 5 and the dry air duct 16. This circulated warm or hot air contains thick ozone gas, and oxidation of the ozone is promoted by the heating to prevent or suppress growth of mold on the inner and outer surfaces of the drum 3, the inner surface of the outer tub 5 and the inner peripheral surface of the dry air duct 16. Further, water deposit, soap scum and the like adhering to these portions are decomposed by the ozone to easily come off.

When 20 minutes, for example, elapse after the start of the mold guard operation, the ozone generator 47 is turned off, the rotation of the drum 3 and the ON-states of the blower 21 and the heater 22 are continued. Then, a lapse of 10 minutes is waited in this state, and the mold guard operation is ended after the lapse of 10 minutes, i.e., when 30 minutes elapse after the start of the mold guard operation.

After the end of the mold guard operation, processing may be performed such as rinsing the outer tub 5 and the drum 3 with water by reserving the water in the outer tub 5 and rotating the drum 3 for 5 minutes, for example, discharging the water and thereafter performing spin-drying by rotating the drum 3 at a high speed to repel the water adhering to the drum 3 may be performed.

When the water deposit, soap scum and the like adhering to the outer tub 5 and the drum 3 come off due to the mold guard operation, these are removed by the rinsing with water, so that the next washing can be waited with the cleaner drum 3 and the outer tub 5.

In place of the structure executing the mold guard operation by the operation of the dedicated key, the mold guard operation may be automatically performed every time the wash operation is performed 10 times, for example, or wash-and-dry operation is performed 10 times, for example.

The present invention is not limited to the embodiment mentioned above, but various modifications are possible within the scope of Claims for patent.

For example, while the embodiment has been described with reference to the full automatic drum-type washing machine 1 provided with the drying function, the present invention is also applicable to a drum-type washing machine having no drying function. The present invention may be an apparatus independent as a sterilizing/deodorizing apparatus for clothes. Alternatively, the present invention may be an apparatus integrated into a drying machine.

Further, the present invention may be applied not to a drum-type washing machine, but to a so-called vertical washing machine.

The invention claimed is:

1. A washing machine, comprising:

a treating tub that houses clothes, for washing, spin-drying, and drying the housed clothes, and that has an outer tub and an inner tub rotatably provided in the outer tub;

a motor for rotating the inner tub;

a circulating air duct for extracting air in the treating tub from one end and returning the extracted air into the treating tub from another end during drying;

a blowing means provided in the circulating air duct for circulating the air in the circulating air duct from said one end to said another end;

a heating means provided in the circulating air duct for heating the air circulated in the circulating air duct;

an ozone generation means connected to the circulating air duct for generating ozone by discharge so that the generated ozone is supplied to the circulating air duct in accordance with operation of the blowing means;

a command key for instructing execution of air wash;

an air wash execution control means for operating the blowing means, the ozone generation means and the heating means in a predetermined mode in response to the instruction from the command key; and a selection key for selecting whether to rotate the inner tub or to stop the inner tub during execution of the air wash.

2. The washing machine according to claim 1, wherein the air wash execution control means operates the blowing means and the heating means, and intermittently operates the ozone generation means at a prescribed time interval in response to an instruction from the command key.

3. The washing machine according to claim 1, wherein the treating tub includes an opening for loading and unloading the clothes, and a lid for opening and closing the opening, and wherein the washing machine has a locking means for locking the lid in a closed state until a constant time elapses when the air wash is interrupted or stopped.

* * * * *